US005091359A

United States Patent [19]

Ishida et al.

[11] Patent Number: 5,091,359

[45] Date of Patent: Feb. 25, 1992

[54] HEAT-SENSITIVE RECORD MATERIAL

[75] Inventors: Koichi Ishida, Amagasaki; Yukio Takayama, Toyonaka, both of Japan

[73] Assignee: Kanzaki Paper Manufacturing Co., Ltd., Tokyo, Japan

[21] Appl. No.: 475,172

[22] Filed: Feb. 5, 1990

[30] Foreign Application Priority Data

Feb. 8, 1989 [JP] Japan ..... 1-29312
Feb. 16, 1989 [JP] Japan ..... 1-38898

[51] Int. Cl.[5] ..... B41M 5/30
[52] U.S. Cl. ..... 503/209
[58] Field of Search ..... 427/150-152; 503/208, 209, 216, 225, 214, 226

[56] References Cited

U.S. PATENT DOCUMENTS 4,370,370 1/1983 Iwata et al. ..... 428/40
4,950,637 8/1990 Okauchi et al. ..... 503/209

FOREIGN PATENT DOCUMENTS 128347 4/1979 Japan ..... 503/226
164579 7/1987 Japan ..... 503/216

*Primary Examiner*—Bruce H. Hess
*Attorney, Agent, or Firm*—Morgan & Finnegan

[57] ABSTRACT

The heat-sensitive record material, in which color images are produced by a color-forming reaction between a colorless or pale colored basic chromogenic material and a color developer, comprises a novolac-type epoxy resin or a diphenyl sulfone derivative represented by the formula (III) in the color forming reaction system.

In the former case, it is preferable to use a novolac-type epoxy resin represented by the formula (I) together witha a compound represented by the formula (II) and, in the latter case, the desired effects can be obtained by using 3-dibutylamino-6-methyl-7-phenylaminofluoran as the basic chromogenic material.

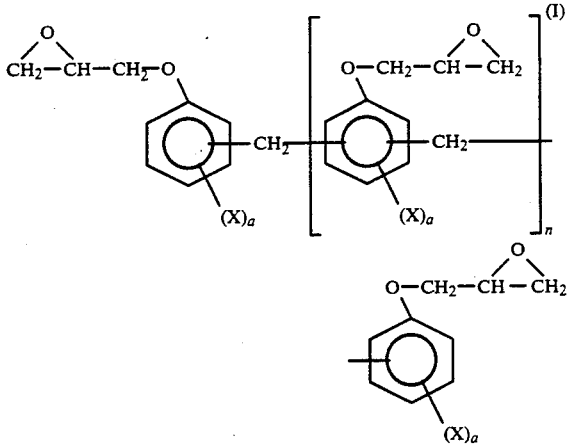

(I)

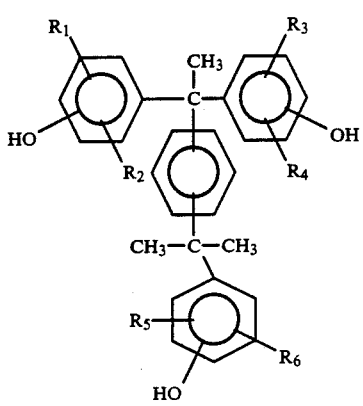

(II)

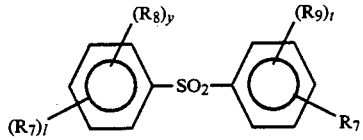

(III)

wherein X is halogen or alkyl having $C_1$ to $C_5$, and a is an integer of 0 to 4; and n is an integer of 0 to 20, each of $R_1 \sim R_6$ is hydrogen, halogen, $C_{1-5}$ alkyl or $C_{1-5}$ alkoxyl, $R_7$ is

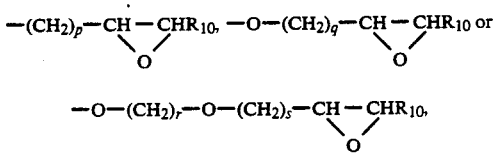

$R_{10}$ is hydrogen or alkyl; each of p and q is 0 or an integer of 1 to 5; each of r and s is an integer of 1 to 5; each $R_8$ and $R_9$ is halogen, alkyl or alkoxyl; l is 0 or 1; u is 0 or an integer of 1 to 5; and t is 0 or an integer of 1 to 4.

6 Claims, No Drawings

HEAT-SENSITIVE RECORD MATERIAL

BACKGROUND OF THE INVENTION

This invention relates to a heat-sensitive record material and particularly to a heat-sensitive record marterial which is superior in retainability of the recorded images.

There has been well-known heat-sensitive record materials utilizing the colorforming reaction between a colorless or pale colored basic chromogenic material and an organic or inorganic color developer, in which the two colorforming materials are thermally brought into contact with each other to produce color images. These heat-sensitive record materials are relatively cheap and the recording machines are compact and easily maintained. Therefore, they have been used not only as a recording medium of facsimiles, various caliculator and the like, but also in the other various fields.

For example, in one case, the application as a label has been increased with the enlargement of the POS (point of sales) systematization in a retail store and the like.

When the POS system is induced in a super-market and the like, there are many cases in which the label is touched with water, lapping films, oil and the like and resultantly the recorded images on the heat-sensitive label are discolored. Therefore, it is required for the heat-sensitive record material to have good retainability of the recorded images, such as water-resistance, plasticizer-resistance, oil-resistance and the like.

As the methods for improving the retainability of the recorded images, there have been proposed such as the method of coating on the heat-sensitive recording layer a water-emulsion of a film-formable resin superior in chemical resistance (Japanese Laid-Open Patent Publication No. 128347 of 1979), the method of coating a water-soluble polymer such as polyvinylalcohol and the like (Japanese Laid-Open Utility Model Publication No. 125354 of 1981), and the method in which various kinds of agents for improving the image retainability are added in the heat-sensitive recording layer. However, in any cases, the other defects such as lowering the image density of the recorded images, lowering the whiteness of the heat-sensitive recording layer and the like are accompanied with the improvement. Satisfactory effects have not been obtained.

Furthermore, sufficient effects have not been obtained in wet-plasticizer-resistance which means water- and plasticizer-resistance.

Japanese Laid-Open Patent Publication No. 164579 of 1987 discloses the method in which diphenylsulfone derivatives having glycidyl group is added in the heat-sensitive recording layer. The retainability of the recorded images is improved by the addition of these compounds in the recording layer, but satisfactory qualities can not be obtained, because the whiteness of the recording layer is remarkably lowered by the occurrence of fogging.

Therefore, it is an object of the present invention to provide a heat-sensitive record material in which the retainability of the recorded images is remarkably improved in both of plasticizer-resistance and oil-resistance and the unrecorded white portion is stably maintained fogging free.

Further, it is an object of the present invention to provide a heat-sensitive record material being superior in image-retainability, in particular superior in plasticizer-resistance, water-resistance and wet-plasticizer resistance and also superior in image density, without lowering the whiteness of the unrecorded portion.

SUMMARY OF THE INVENTION

In the heat-sensitive record material according to the invention, in which color images are produced by a color-forming reaction between a colorless or pale colored basic chromogenic material and a color developer, a novolac-type epoxy resin is comprised in the color forming reaction system to achieve the above mentioned objects.

The heat-sensitive record material according to the invention generally has on a base sheet a heat-sensitive recording layer which comprises a colorless or pale colored basic chromogenic material and a color developer which develops a color by contacting with the chromogenic material. It is preferable that the heat-sensitive recording layer contains at least one novolac-type epoxy resin represented by the following formula (I);

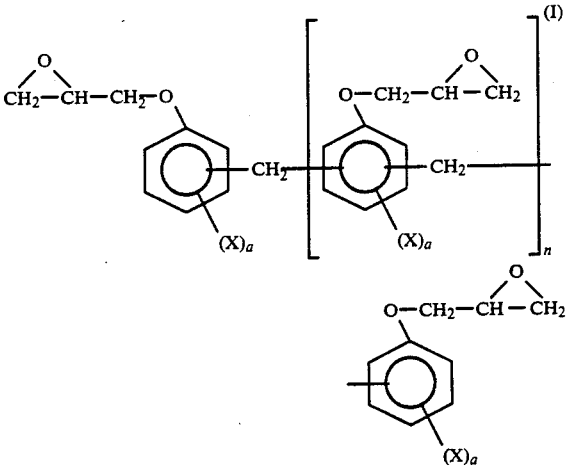

(I)

wherein X is a halogen atom or an alkyl having $C_1$ to $C_5$, and a is an integer of 0 to 4; and n is an integer of 0 to 20.

Further, it is preferable for the heat-sensitive record material according to the invention to comprise the compound represented by the following formula (II) in the colorforming reaction system together with the novolac-type epoxy resin represented by the general formula (I);

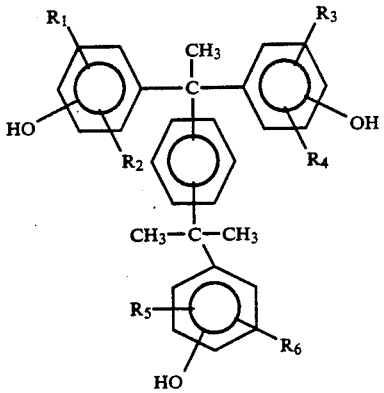

(II)

wherein $R_1$, $R_2$, $R_3$, $R_4$, $R_5$ and $R_6$ may be same or different from each other, and represent a hydrogen atom, halogen atom, alkyl having $C_1$ to $C_5$ or alkoxyl having $C_1$ to $C_5$ respectively.

The another preferable heat-sensitive record material according to the invention comprises 3-dibutylamino-6-methyl-7-phenylaminofluor an as the basic chromogenic material together with a diphenylsulfone derivative represented by the following formula (III) in the recording layer;

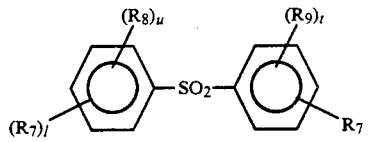

(III)

wherein $R_7$ is $$-(CH_2)_p-\underset{O}{\underset{\diagdown}{CH}}-\underset{\diagup}{CHR_{10}},\quad -O-(CH_2)_q-\underset{O}{\underset{\diagdown}{CH}}-\underset{\diagup}{CHR_{10}}$$

or $$-O-(CH_2)_r-O-(CH_2)_s-\underset{O}{\underset{\diagdown}{CH}}-\underset{\diagup}{CHR_{10}};$$

$R_{10}$ is a hydrogen atom or an alkyl; each of p and q is 0 or an integer of 1 to 5; each of r and s is an integer of 1 to 5; each $R_8$ and $R_9$ is a halogen atom, alkyl or alkoxyl; l is 0 or 1; u is 0 or an integer of 1 to 5; and t is 0 or an integer of 1 to 4.

DETAILED DESCRIPTION OF THE INVENTION

As described above, the one type of the heat-sensitive record material according to the invention is characterized in comprising a novolac-type epoxy resin in the color forming reaction system. The novolac-type epoxy resin may be selected from phenol novolac-type epoxy resins, halogen-substituted phenol novolac-type epoxy resins and cresol novolac-type epoxy resins and so on.

Particularly, the novolac-type epoxy resin represented by the general formula (I) is useful.

The resin represented by the general formula (I) includes a phenol novolac-type epoxy resin, a brominated phenol novolac-type epoxy resin and an ortho-cresol novolac-type epoxy resin and the like. These compounds can be obtained by reacting a phenol novolac which is a reaction product of phenol and formaldehyde, brominated phenol novolac which is a reaction product of phenol, formaldehyde and bromine, or ortho-cresol novolac which is a reaction product of ortho-cresol and formaldehyde with epichlorohydrin.

The preferable novolac-type epoxy resin represented by the general formula (I) is that in which n is an integer of 2 to 7. The epoxy resin may be used either solely or in combination.

Further, it is preferable that the novolac-type epoxy resins in a solid having a softening point of 60° to 140° C., particularly 60° to 100° C. and it is preferable that "a" in the general formula (I) is an integer of 0 to 3.

If the softening point of the novolac-type epoxy resin is too low, the whiteness of the record material tends to be lowered. On the contrary, if the softening point is too high, the improved effects in relainability of the developed color images tends to be lowered.

Additionally, the heat-sensitive record material according to the invention may have a protecting layer as the most upper layer of the recording surface. The novolac-type epoxy resin may be included in the protective layer and the like, but it is usually included in the heat-sensitive recording layer in view of the recording characteristics in the instruments, i.e., to prevent sticking phenomenon or piling phenomenon.

According to the invention, the heat-sensitive record materials, which are very improved in plasticizer-resistance and oil-resistance and also in whiteness on the background, can be obtained by using the novolac-type epoxy resin as described above. The usage amount of the novolac-type epoxy resin is not particularly limited, but, generally it is used within the range of 0.1 to 500 parts by weight, preferably 1 to 200 parts by weight per 100 parts by weight of the color developer.

Further, the heat-sensitive record material according to the invention may comprise the compound represented by the general formula (II) in the colorforming reaction system together with the novolac-type epoxy resin. By using the compound represented by the general formula (II), there can be obtained the heat-sensitive record materials even more improved in retainability of the developed color images, particularly superior in plasticizer-resistance, water-resistance and wer-plasticizer-resistance.

As the compounds represented by the general formula (II), there are exemplified the compounds such as 1-[α-methyl-α-(4'-hydroxyphenyl)ethyl]-4-[α',α'-bis(4''-hydroxyphenyl)ethyl]benzene, 1-[α-methyl-α-(4'-hydroxyphenyl)ethyl]-3-[α',α'-bis(4''-hydroxyphenyl)ethyl]benzene, 1-[α-methyl-α-(3',5'-dimethyl-4'-hydroxyphenyl)ethyl]-4-[α',α'-bis(3'',5''-dimethyl-4''-hydroxyphenyl)ethyl]benzene, 1-[α-methyl-α-(3'-methyl-4'-hydroxyphenyl)ethyl]-4-[α',α'-bis(3''-methyl-4''-hydroxyphenyl)ethyl]benzene, 1-[α-methyl-α-(3',5'-dichloro-4'-hydroxyphenyl)ethyl]-4-[α',α'-bis(3'',5''-dichloro-4''-hydroxyphenyl)ethyl]benzene, 1-[α-methyl-α-(3'-methoxy-4'-hydroxyphenyl)ethyl]-4-[α',α'-bis(-3''-methoxy-4''-hydroxyphenyl)ethyl]benzene and the like. The compound represented by the general formula (II) is preferably added within the range of 0.1 to 1000 parts by weight, more preferably 10 to 300 parts by weight per 100 parts of the color developer.

The most preferable compound represented by the general formula (II) is 1-[α-methyl-α-(4'-hydroxyphenyl)ethyl]-4-[α',α'-bis(4''-hydroxy-phenyl)ethyl]-benzene.

As the basic chromogenic materials used in the present invention, there are exemplified various well-known colorless or pale colored basic chromogenic materials. For example, triallylmethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and the like; diphenylmethane compounds such as 4,4'-bis-dimethylaminobenzhydryl benzyl ether, N-halophenyl-leucoauramine, N-2,4,5-trichlorophenyl-leucoauramine and the like; thiazine compounds such as benzoylleucomethylene blue, p-nitrobenzoyl-leucomethylene blue and the like; spiro compounds such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran and the like; lactam compounds such as Rhodamine-B anilinolactam, Rhodamine(p-nitroanilino)lactam, Rhodamine(o-chloroanilino)lactam and the like; and fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino- 7-(o-chlorophenylamino)fluoran, 3-pyrrolidino-6-methyl-7-p-butylphenylaminofluoran, 3-diethylamino-7-(o-fluorophenylamino)fluoran, 3-dibutylamino-7-(o-fluorophenylamino) fluoran, 3-dibutylamino-6-methyl-7-phenylaminofluoran, 3-(N-methyl-N-n-amyl)amino-6-methyl-7-phenylaminofluoran, 3-(N-ethyl-N-n-amyl-)amino-6-methyl-7-phenylaminofluoran, 3-(N-ethyl-N-iso-amyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-$\beta$-ethylhexyl-)amino-6-methyl-7-phenylaminofluoran, and the like. The basic chromogenic materials may be used either solely or in combination.

As the developers which develop a color by contacting with the above basic chromogenic materials, there have been known various kinds of inorganic or organic acidic compounds. For example, there are included inorganic acidic compounds such as activated clay, attapulgite, colloidal silica, aluminum silicate and the like; organic acidic compounds such as phenolic compounds, e.g., 4-tert-butylphenol, 4-hydroxydiphenoxide, $\alpha$-naphthol, $\beta$-naphthol, 4-hydroxyacetophenol, 4-tert-octylcatechol,2,2'-dihydroxydiphenol, 4,4'-isopropylidenebis(2-tert-butylphenol), 4,4'-sec-butylidenediphenol, 4-phenylphenol, 4,4'-isopropylidenediphenol, 2,2-bis(4-hydroxyphenyl)-4-methylpentane, 2,2'-methylenebis(4-chlorophenol), hydroquinone, 4,4'-cyclohexylidenediphenol, 4,4'-dihydroxydiphenylsulfide, hydroquinone monobenzyl ether, 4-hydroxy-benzophenone, 2,4-dihydroxybenzophenone, 2,4,4'-tri-hydroxybenzophenone, 2,2',4,4'-tetrahydroxybenzophenone, dimethyl 4-hydroxyphthalate, methyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin, phenol polymers and the like; aromatic carboxylic acids, e.g., benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, 3-tert-butylsalicyclic acid, 3-benzylsalicylic acid, 3-($\alpha$-methylbenzyl)salicylic acid, 3-chloro-5-($\alpha$-methylbenzyl)salicylic acid, 3,5-di-tert-butylsalicylic acid, 3-phenyl-5-($\alpha$,$\alpha$-dimethylbenzyl)salicylic acid, 3,5-di-$\alpha$-methylbenzylsalicylic acid and the like; 4-hydroxydiphenylsulfone derivatives such as 4,4'-dihydroxydiphenylsulfone, 4-hydroxy-4'-isopropyloxydiphenylsulfone, bis(3-allyl-4-hydroxyphenyl)sulfone, 4-hydroxy-4'-methyldiphenylsulfone, 3,4-dihydroxydiphenylsulfone, 3,4-dihydroxy-4'-methyldiphenylsulfone and the like; sulfide derivatives such as bis(3-tert-butyl-4-hydroxy-6-methylphenyl)sulfide, bis(2-methyl-4-hydroxy-6-tert-butylphenyl)sulfide, 4,4'-methylenebis(oxyethylenethio)diphenol, 1,5-di(4-hydroxyphenylthio)-3-oxapentane and the like; and salts of the above phenolic compounds or aromatic carboxylic acids with polyvalent metals such as zinc, magnesium, aluminum, calcium, titanium, manganese, tin and nickel; and organic acidic compounds such as antipyrine complex of zinc thiocyanate and the like.

The used ratio of the basic chromogenic materials and the above color developer may be suitably selected depending on the kind of the basic chromogenic material and the color developer, and accordingly is not particularly limited. However, the used amount of the color developer is generally within the range of 1 to 50 parts by weight, preferably 2 to 10 parts by weight, per one part by weight of the basic chromogenic materials.

As the another type of the invention, the diphenylsulfone derivatives represented by the general formula (III) may be used instead of the compound represented by the general formula (I). In this case, the heat-sensitive record material which is remarkably improved in retainability of the recorded color images, particularly plasticizer-resistance and oil-resistance can be obtained, but the heat-sensitive record material is inferior in the whiteness.

However, when 3-dibutylamino-6-methyl-7-phenylaminofluoran is used as the basic chromogenic compound together with the diphenylsulfone derivatives represented by the general formula (III), the heat-sensitive record materials very superior in both of the retainability of color images and the whiteness can be obtained.

As the diphenylsulfone derivatives represented by the general formula (III), there are exemplified the following compounds such as 4-(1,2-epoxyethyl)diphenylsulfone, 4-glycidyldiphenylsulfone, 4-(3,4-epoxybutyl)-diphenylsulfone, 4-(2,3-epoxybutyl)diphenylsulfone, 4-(1,2-epoxyethyloxy)diphenylsulfone, 4-glycidyloxydiphenylsulfone, 4-(3,4-epoxybutyloxy)diphenylsulfone, 4-(2,3-epoxybutyloxy)diphenylsulfone, 4-glycidyloxy-4'-chlorodiphenylsulfone, 4-glycidyloxy-4'-bromodiphenylsulfone, 4-glycidyloxy-4'-methyldiphenylsulfone, 4-glycidyloxy-4'-ethyldiphenylsulfone, 4-glycidyloxy-2',4'-dimethyldiphenylsulfone, 4-glycidyloxy-2',4'-dichlorodiphenylsulfone, 4-glycidyloxy-4'-(n-propyl)diphenylsulfone, 4-glycidyloxy-4'-isopropyldiphenylsulfone, 4-glycidyloxy-4'-(tert-butyl)diphenylsulfone, 4-glycidyloxy-4'-isoamyldiphenylsulfone, 4-glycidyloxy-4'-methoxydiphenylsulfone, 4-glycidyloxy-4'-ethoxydiphenylsulfone, 4-glycidyloxy-4'-isopropyloxydiphenylsulfone, 4-glycidyloxy-4'-n-pentyloxydiphenylsulfone, 4-glycidyloxy-2',4'-dimethoxydiphenylsulfone, 4,4'-diglycidyloxy-diphenylsulfone, 4,4'-diglycidyloxy-3,3'-dichlorodiphenylsulfone, 4,4'-diglycidyloxy-2,2'-dibromodiphenylsulfone, 4,4'-diglycidyloxy-3,3',5,5'-tetrabromodiphenylsulfone, 4,4'-bis-(2-glycidyloxyethoxy)diphenylsulfone, 4,4'-bis(2-glycidyloxyethoxy)-3,3',5,5'-tetrabromodiphenylsulfone, 4,4'-bis(2-glycidyloxyethoxy)-3,3',5,5'-tetrachlorodiphenylsulfone, 4,4'-bis(2-glycidyloxyethoxy)-3,3',5,5'-tetramethyldiphenylsulfone, 4,4'-bis(3,4-epoxybutyloxy)diphenylsulfone and the like. The compounds may be used either solely or in combination.

In the above general formula (III), the carbon number of alkyl or alkoxyl as $R_8$ and $R_9$ is preferably 1 to 4.

Further, the usage amount of the above diphenylsulfone derivatives is not particularly limited, however, it is generally within the range of 0.1 to 500 parts by weight, preferably 1 to 200 parts by weight, to 100 parts by weight of the color developer.

3-dibutylamono-6-methyl-7-phenylaminofluoran is selectively used as the basic chromogenic material with the compound represented by the general formula (III), however, a general basic chromogenic material described above may be used together within the range in which the effect of the present invention is not inhibited.

The preferable used amount of 3-dibutylamono-6-methyl-7-phenylaminofluoran is at least 65% by weight, more preferably at least 90% by weight, on the basis of the total amount of the basic chromogenic materials, because it inhibits the desired effect of the invention to use a large amount of the other basic chromogenic material together with the diphenylsulfone derivative represented by the general formula (III).

In this case, it is also preferable for the recording layer to include the compound represented by the general formula (II) such as 1-[α-methyl-α-(4'-hydroxyphenyl)ethyl]-4-[α',α'-bis(4''-hydroxyphenyl)ethyl]benzene together with the diphenylsulfone derivative represented by the general formula (III).

As the developers which develop a color by contacting with the basic chromogenic materials, there may be used same compounds as described hereinbefore and the usage amount of them is also same as described hereinbefore.

The recording layer of the heat-sensitive record material is generally formed by coating on a base sheet an aqueous coating composition comprising a chromogenic material and a color developer. The coating composition may be prepared with the use of a mixer or pulverizer such as ball mill, sand mill or the like.

Among the binders contained in the coating composition, there are included starches, hydroxyethylcellulose, methylcellulose, carboxymethylcellulose, gelatin, casein, gum arabic, polyvinyl alcohol, acetoacetylated polyvinyl alcohol, carboxyl-group modified polyvinyl alcohol, silicon-containing modified polyvinyl alcohol, salts of diisobutylene-maleic anhydride copolymer, salts of styrene-maleic anhydride copolymer, salts of ethylene-acrylic acid copolymer, salts of styrene-acrylic acid copolymer, styrene-butadiene copolymer emulsions, urea resin, melamine resin, amide resin and the like. The binders are preferably used in an amount of 10 to 40% by weight, more preferably 15 to 30% by weight on dry basis.

Further, if necessary, the coating composition may include various kinds of additives such as dispersing agents, e.g., sodium dioctylsulfosuccinate, sodium dodecylbenzenesulfonate, sodium salt of lauryl alcohol sulfate, metal salts of fatty acids and the like; ultraviolet ray absorbers, e.g., benzophenone compounds and the like; antifoaming agents; fluorescent dyes; coloring dyes; lubricants, e.g., zinc stearate, calcium stearate, polyethylene wax, carnauba wax, paraffin wax, ester wax and the like; inorganic pigments, e.g., kaolin, clay, talc, calcium carbonate, calcined kaolin, titanium dioxide, diatom earth, fine-grain anhydrous silica, activated clay and the like. Sensitizers may be used simultaneously.

As the sensitizers, there may be used fatty acid amides such as stearic acid amide, methylenebis stearic acid amide, oleic acid amide, palmitic acid amide, coconut aliphatic acid amide and the like; hindered phenols such as 2,2'-methylenebis(4-methyl-6-tert-butylphenyl), 4,4'-butylidenebis(6-tert-butyl-3-methylphenol), 2,2'-methylenebis(4-ethyl-6-tert-butylphenol), 2,4-di-tert-butyl-3-methylphenol and the like; ultraviolet ray absorbers such as 2-(2'-hydroxy-5'-methylphenyl)benztriazole, 2-hydroxy-4-benzyloxy-benzophenone and the like; 1,2-di(3-methylphenoxy)ethane, 1,2-diphenoxyethane, 1-phenoxy-2-(4-methylphenoxy)ethane, naphthyl benzyl ether, benzyl-4-methyl thiophenyl ether, dimethyl terephthalate, dibutyl terephthalate, dibenzyl terephthalate, dibutyl isophthalate, phenyl 1-hydroxynaphthoate, benzyl-4-methyl thiophenyl ether and various known heat-fusible materials.

Among them, 1,2-di(3-methylphenoxy)ethane, 1,2-diphenoxyethane, 1-phenoxy-2-(4-methylphenoxy)ethane are most preferably used.

The usage amount of the sensitizer is not particularly limited, however, it is generally preferable to adjust the amount within the range of not more than 4 parts by weight per one part by weight of the color developer.

As the coating methods, there may be used various known methods such as air-knife coating method, rod-blade coating method, pure-blade coating method, short-dwelltime-coating method and the like. The amount of the applied coating composition is not also particularly limited, but it is generally controlled within the range of 2 to 12 g/m$^2$, preferably 3 to 10 g/m$^2$ on dry basis.

In the heat-sensitive record materials according to the invention, the retainability of the recorded images can be further improved by forming a protective layer on the heat-sensitive record layer.

The protective layer contains a water-soluble or water-dispersible polymer. As such polymers, various kinds of the binders as described above may be used. Among them, carboxyl-group modified polyvinyl alcohol, acetoacetylated polyvinyl alcohol and silicon-containing modified polyvinyl alcohol are preferably used, because of their suitable functions.

To further improve the water-resistance, there may be used a hardener together with the polymer. As the hardners, there are exemplified such as glyoxal, formaldehyde, glycine, glycidyl ester, glycidyl ether, urea dimethylol, ketene dimer, starch dialdehyde, melamine resin, polyamide resin, polyamide-epichlorohydrin resin, ketone-aldehyde resin, borax, boric acid, zirconium carbonate ammonium, epoxy-type compounds and the like.

If desired, pigments may be added in the protective layer to improve printing suitability and sticking troubles. As the pigments, there are exemplified inorganic pigments such as calcium carbonate, zinc oxide, aluminum oxide, titanium dioxide, silicon dioxide, aluminum hydroxide, barium sulfate, zinc sulfate, talc, kaolin, clay, calcined kaolin, coloidal silica and the like; organic pigments such as styrene microballs, Nylon powder, polyethylene powder, ureaformaldehyde resin filler, raw starch and the like. The usage amount of the pigments is preferable to be adjusted within the range of 5 to 500 parts by weight per 100 parts by weight of the binders.

Further, there may be added in the coating composition for the protective layer, if desired, various known additives such as lubricants, e.g., zinc stearate, calcium stearate, polyethylene wax, carnauba wax, paraffin wax and ester wax; surface-active agents or dispersing agents, e.g., sodium dioctylsulfosuccinate; anti-foaming agent and the like.

The coating composition is generally prepared with the use of water as the dispersion medium.

Thus obtained coating composition for the protective layer may be coated on the heat-sensitive recording layer by a suitable coating machine. The coated amount of the composition is generally controlled within the range of 0.1 to 20 g/m$^2$, preferably 0.5 to 10 g/m$^2$ on dry basis, because the recording sensitivity of the heat-sensitive record material is lowered if the coated amount is more than 20 g/m$^2$.

The retainability of the recorded images may be further improved by forming a protective layer on the back side of the heat-sensitive record material. Furthermore, there may be added various kinds of well-known technique for producing the heat-sensitive record material, such as formation of an under-coating layer on the base sheet, application of an adhesive on the back side of the record material to make an adhesive labels and so on.

As the base sheet, paper, plastic film, synthetic paper and the like may be used. Paper is most preferably used in terms of the cost and the coating suitability.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

EXAMPLE 1

① Preparation of dispersion A

The following composition was pulverized by a sand mill, and the pulverization was continued until an average particle size of 3 μm.

| | |
|---|---|
| 3-dibutylamino-6-methyl-7-phenylaminofluoran | 10 parts |
| 5% aqueous solution of methylcellulose | 5 parts |
| water | 40 parts |

② Preparation of dispersion B

The following composition was pulverized by a sand mill, and the pulverization was continued until an average particle size of 3 μm.

| | |
|---|---|
| 4,4'-isopropylidenediphenol | 30 parts |
| 5% aqueous solution of methylcellulose | 5 parts |
| water | 80 parts |

③ Preparation of dispersion C

The following composition was pulverized by a sand mill, and the pulverization was continued until an average particle size of 3 μm.

| | |
|---|---|
| 1,2-di(3-methylphenoxy)ethane | 20 parts |
| 5% aqueous solution of methylcellulose | 5 parts |
| water | 55 parts |

④ Preparation of dispersion D

The following composition was pulverized by a sand mill, and the pulverization was continued until an average particle size of 3 μm.

| | |
|---|---|
| ortho-cresol novolac-type epoxy resin (Trade name: ECN-299 manufactured by Asahi Kasei Kogyo Kabushiki Kaisha; softening point: 97° C.; mixture of the compounds represented by the general formula (I) in which X is methyl substituted at ortho-position to glycidyloxy group, a is 1 and n is an integer of 2 to 7) | 20 parts |
| 5% aqueous solution of methylcellulose | 5 parts |
| water | 55 parts |

⑤ Formation of a recording layer

The following composition was mixed with stirring to prepare a coating composition.

| | |
|---|---|
| dispersion A | 55 parts |
| dispersion B | 115 parts |
| dispersion C | 80 parts |
| dispersion D | 24 parts |
| 10% aqueous solution of polyvinyl alcohol | 80 parts |
| calcium carbonate | 35 parts |

The coating composition was coated in the weight of an amount of 6 g/m$^2$ on dry basis on a base sheet of 50 g/m$^2$ and dried to a heat-sensitive record material having a recording layer on the base sheet.

EXAMPLE 2

A heat-sensitive record material was obtained in the same manner as in Example 1 except that 4-hydroxy-4'-isopropoxydiphenylsulfone was used instead of 4,4'-isopropylidenediphenol to prepare the dispersion B.

EXAMPLE 3

A heat-sensitive record material was obtained in the same manner as in Example 1 except that ortho-cresol novolac-type epoxy resin (Trade name: ECN-285 manufactured by Asahi Kasei Kogyo Kabushiki Kaisha;

softening point: 86° C.; mixture of the compounds represented by the general formula (I) in which X is methyl substituted at ortho-position to glycidyloxy group, a is 1 and n is an integer of 2 to 7) was used instead of ortho-cresol novolac-type epoxy resin (Trade name: ECN-299 manufactured by Asahi Kasei Kogyo Kabushiki Kaisha) to prepare the dispersion D.

EXAMPLE 4

A heat-sensitive record material was obtained in the same manner as in Example 1 except that ortho-cresol novolac-type epoxy resin (Trade name: EX-695 manufactured by Nagase Kasei Kogyo Kabushiki Kaisha; softening point: 93° C.; mixture of the compounds represented by the general formula (I) in which X is methyl substituted at ortho-position to glycidyloxy group, a is 1 and n is an integer of 2 to 7) was used instead of ortho-cresol novolac-type epoxy resin (Trade name: ECN-299 manufactured by Asahi Kasei Kogyo Kabushiki Kaisha) to prepare the dispersion D.

EXAMPLE 5

A heat-sensitive record material was obtained in the same manner as in Example 1 except that phenol novolac-type epoxy resin (Trade name: XD-7855 manufactured by Dow Chemical Company; softening point: 73° C.; mixture of the compounds represented by the general formula (I) in which a is 0 and n is an integer of 2 to 7) was used instead of ortho-cresol novolac-type epoxy resin (Trade name: ECN-299 manufactured by Asahi Kasei Kogyo Kabushiki Kaisha) to prepare the dispersion D.

EXAMPLE 6

A heat-sensitive record material was obtained in the same manner as in Example 1 except that brominated phenol novolac-type epoxy resin (softening point: 90° C.; mixture of the compounds represented by the general formula (I) in which X is a bromine atom, a is 1 and n is an integer of 2 to 7) was used instead of ortho-cresol novolac-type epoxy resin (Trade name: ECN-299 manufactured by Asahi Kasei Kogyo Kabushiki Kaisha) to prepare the dispersion D.

EXAMPLE 7

A heat-sensitive record material was obtained in the same manner as in Example 2 except that 3-(N-ethyl-N-isoamyl)amino-6-methyl-7-phenylaminofluoran was used instead of 3-dibutylamino-6-methyl-7-phenylaminofluoran to prepare the dispersion A.

COMPARATIVE EXAMPLE 1

A heat-sensitive record material was obtained in the same manner as in Example 1 except that the dispersion D was not added to the coating composition for forming the recording layer.

COMPARATIVE EXAMPLE 2

A heat-sensitive record material was obtained in the same manner as in Example 2 except that the dispersion D was not added to the coating composition for forming the recording layer.

The properties of thus obtained 9 heat-sensitive record materials were evaluated by the following methods. The results are shown in Table 1.

Whiteness

The whiteness, brightness by Hunter, of the unrecorded portion of the recording layer was measured by Hunter multipurpose reflectometer to evaluate the degree of fogging.

Image density of the developed color

The heat-sensitive record material was printed by a thermal printer PC-100A manufactured by Texas Instruments Inc. to develop color images. The image density of the color images was measured by Macbeth densitometer RD-100R manufactured by Macbeth Corp.

Plasticizer resistance

A polyvinyl chloride film manufactured by Mitsui Toatsu Chemicals, Inc. was wrapped threefold around a polypropylene pipe having a diameter of 40 mm. A heat-sensitive record material after developing color images was put on the outer surface in the manner as the color images are exposed outward and further the same polyvinyl chloride film was wrapped threefold around the heat-sensitive record material.

The resultant material was allowed to stand at 30° C. for 24 hours, and then the image density of the color images was measured.

TABLE I

| | Whiteness (%) | Image density of the developed color | Plasticizer resistance |
|---|---|---|---|
| Examples | | | |
| 1 | 81.5 | 1.24 | 1.10 |
| 2 | 83.0 | 1.20 | 1.16 |
| 3 | 81.3 | 1.22 | 1.06 |
| 4 | 81.2 | 1.24 | 1.12 |
| 5 | 81.3 | 1.23 | 1.07 |
| 6 | 81.4 | 1.23 | 1.09 |
| 7 | 81.0 | 1.24 | 1.12 |
| Comparative Examples | | | |
| 1 | 81.6 | 1.24 | 0.20 |
| 2 | 83.0 | 1.20 | 0.45 |

EXAMPLE 8

(1) Formation of a recording layer

A recording layer was formed on the base sheet in the same manner as in Example 1.

(2) Formation of a protective layer 100 parts of 10% aqueous solution of acetoacetylated polyvinyl alcohol, 20 parts of calcium carbonate and 50 parts of water were mixed with stirring to prepare a coating composition. The coating composition was coated in the weight of an amount of 6 g/m$^2$ on dry basis on the above recording layer and dried to obtain a heat-sensitive record material having a protective layer.

EXAMPLE 9

(1) Formation of a recording layer

A recording layer was formed on the base sheet in the same manner as in Example 2.

(2) Formation of a protecting layer

A protective layer was formed on the above recording layer in the same manner as in Example 8 to obtain a heat-sensitive record material having a protective layer.

EXAMPLE 10

① Formation of a recording layer

A recording layer was formed on the base sheet in the same manner as in Example 4.

② Formation of a protecting layer

A protective layer was formed on the above recording layer in the same manner as in Example 8 to obtain a heat-sensitive record material having a protective layer.

EXAMPLE 11

① Formation of a recording layer

A recording layer was formed on the base sheet in the same manner as in Example 5.

② Formation of a protecting layer

A protective layer was formed on the above recording layer in the same manner as in Example 8 to obtain a heat-sensitive record material having a protective layer.

EXAMPLE 12

① Formation of a recording layer

A recording layer was formed on the base sheet in the same manner as in Example 7.

② Formation of a protecting layer

A protective layer was formed on the above recording layer in the same manner as in Example 8 to obtain a heat-sensitive record material having a protective layer.

COMPARATIVE EXAMPLE 3

① Formation of a recording layer

A recording layer was formed on the base sheet in the same manner as in Comparative Example 1.

② Formation of a protecting layer

A protective layer was formed on the above recording layer in the same manner as in Example 8 to obtain a heat-sensitive record material having a protective layer.

COMPARATIVE EXAMPLE 4

① Formation of a recording layer

A recording layer was formed on the base sheet in the same manner as in Comparative Example 2.

② Formation of a protecting layer

A protective layer was formed on the above recording layer in the same manner as in Example 8 to obtain a heat-sensitive record material having a protective layer.

The properties of thus obtained 7 heat-sensitive record materials were evaluated by the following methods. The results are shown in Table 2.

Whiteness

The same method as used in Table 1.

Image density of the developed color

The same method as used in Table 1.

Plasticizer-resistance

The same method as used in Table 1 was carried out except that the resultant material was allowed to stand at 40° C. for 24 hours instead of 30° C. for 24 hours.

Wet-plasticizer-resistance

The heat-sensitive record material was slightly wetter by water and then tested in the same manner as in the above plasticizer-resistance test.

TABLE 2

| | Whiteness (%) | Image density of the developed color | Plasticizer-resistance | Wet-plasticizer resistance |
|---|---|---|---|---|
| Examples | | | | |
| 8 | 80.5 | 1.13 | 1.03 | 1.00 |
| 9 | 81.4 | 1.10 | 1.08 | 1.03 |
| 10 | 80.6 | 1.12 | 1.04 | 1.01 |
| 11 | 80.4 | 1.12 | 1.02 | 1.00 |
| 12 | 80.2 | 1.14 | 1.02 | 1.01 |
| Comparative Example | | | | |
| 3 | 80.0 | 1.13 | 0.25 | 0.15 |
| 4 | 81.3 | 1.10 | 0.42 | 0.20 |

EXAMPLE 13

① Preparation of dispersion $A_2$

The following composition was pulverized by a sand mill, and the pulverization was continued until an average particle size of 3 μm.

| | |
|---|---|
| 3-dibutylamino-6-methyl-7-phenylaminofluoran | 10 parts |
| 5% aqueous solution of methylcellulose | 5 parts |
| water | 40 parts |

② Preparation of dispersion $B_2$

The following composition was pulverized by a sand mill, and the pulverization was continued until an average particle size of 3 μm.

| | |
|---|---|
| 4-hydroxy-4'-isopropoxy-diphenylsulfone | 30 parts |
| 5% aqueous solution of methylcellulose | 5 parts |
| water | 80 parts |

③ Preparation of dispersion $C_2$

The following composition was pulverized by a sand mill, and the pulverization was continued until an average particle size of 3 μm.

| | |
|---|---|
| 1,2-di(3-methylphenoxy)ethane | 20 parts |
| 5% aqueous solution of methylcellulose | 5 parts |
| water | 55 parts |

④ Preparation of dispersion $D_2$

The following composition was pulverized by a sand mill, and the pulverization was continued until an average particle size of 3 μm.

| | |
|---|---|
| 1-[α-methyl-α-(4'-hydroxyphenyl)ethyl]-4-[α',α'-bis(4''-hydroxyphenyl)ethyl]benzene | 20 parts |
| 5% aqueous solution of methylcellulose | 5 parts |
| water | 55 parts |

(5) Preparation of dispersion $E_2$

The following composition was pulverized by a sand mill, and the pulverization was continued until an average particle size of 3 μm.

| | |
|---|---|
| ortho-cresol novolac-type epoxy resin (softening point: 97° C.; mixture of the compounds represented by the general formula (I) in which X is methyl substituted at ortho-position to glycidyloxy group, a is 1 and n is an integer of 2 to 7) | 20 parts |
| 5% aqueous solution of methylcellulose | 5 parts |
| water | 55 parts |

(6) Formation of a recording layer

The following composition was mixed with stirring to prepare a coating composition.

| | |
|---|---|
| dispersion $A_2$ | 55 parts |
| dispersion $B_2$ | 115 parts |
| dispersion $C_2$ | 80 parts |
| dispersion $D_2$ | 80 parts |
| dispersion $E_2$ | 80 parts |
| 10% aqueous solution of polyvinyl alcohol | 80 parts |
| calcium carbonate | 35 parts |

The coating composition was coated in the weight of an amount of 6 g/m$^2$ on dry basis on a base sheet of 50 g/m$^2$ and dried to obtain a heat-sensitive record material having a recording layer on the base sheet.

(7) Formation of a protective layer

The following coating composition was coated on the above recording layer in an amount of 6 g/m$^2$ on dry basis, and dried to obtain a heat-sensitive record material having a protective layer.

| | |
|---|---|
| Acetoacetylated polyvinyl alcohol (solid amount: 10%) | 100 parts |
| calcium carbonate | 20 parts |
| water | 50 parts |

EXAMPLE 14

A heat-sensitive record material was obtained in the same manner as in Example 13 except that phenol novolac-type epoxy resin (softening point: 73° C.; mixture of the compounds represented by the general formula (I) in which a is 0 and n is an integer of 2 to 7) was used instead of ortho-cresol novolac-type epoxy resin to prepare the dispersion $E_2$.

EXAMPLE 15

A heat-sensitive record material was obtained in the same manner as in Example 13 except that brominated phenol novolac-type epoxy resin (softening point: 90° C.; mixture of the compound represented by the general formula (I) in which X is a bromine, a is 1 and n is an integer of 2 to 7) was used instead of ortho-cresol novolac-type epoxy resin to prepare the dispersion $E_2$.

EXAMPLE 16

A heat-sensitive record material was obtained in the same manner as in Example 13 except that silicon-containing modified polyvinyl alcohol (10% concentration) was used instead of acetoacetylated polyvinyl alcohol to prepare the coating composition for the protective layer.

EXAMPLE 17

A heat-sensitive record material was obtained in the same manner as in Example 13 except that the dispersion $D_2$ was not used to prepare the coating composition for the recording layer.

COMPARATIVE EXAMPLE 5

A heat-sensitive record material was obtained in the same manner as in Example 13 except that the dispersion $E_2$ was not used to prepare the coating composition for the recording layer.

The properties of thus obtained 6 heat-sensitive record materials were evaluated by the following methods. The results are shown in Table 3.

Whiteness

The same manner as used in Table 1.

Image density of the developed color

The same manner as used in Table 1.

Water-resistance

After developing color images, the heat-sensitive record material was dipped into water for 48 hours and then the image desity of the color images was measured.

Plasticizer-resistance

The same manner as used in Table 1 was carried out except that the resultant material was allowed to stand at 40° C. for 48 hours instead of 30° C. for 24 hours.

Wet-plasticizer-resistance

The heat-sensitive record material was slightly wetted by water and then tested in the same manner as in the above plasticizer-resistance test.

TABLE 3

| | Whiteness (%) | Image density of the developed color | Water-resistance | Plasticizer-resistance | Wet-plasticizer-resistance |
|---|---|---|---|---|---|
| Example | | | | | |
| 13 | 81.4 | 1.12 | 1.09 | 1.10 | 1.02 |
| 14 | 81.5 | 1.09 | 1.08 | 1.05 | 1.01 |
| 15 | 81.2 | 1.10 | 1.09 | 1.06 | 1.02 |
| 16 | 81.5 | 1.10 | 1.06 | 1.09 | 1.00 |
| 17 | 81.6 | 1.10 | 0.72 | 1.08 | 0.79 |
| Comparative Example | | | | | |
| 5 | 81.5 | 1.12 | 1.01 | 0.30 | 0.58 |

EXAMPLE 18

① Preparation of dispersion $A_3$

The following composition was pulverized by a sand mill, and the pulverization was continued until an average particle size of 3 μm.

| | |
|---|---|
| 3-dibutylamino-6-methyl-7-phenylaminofluoran | 10 parts |
| 5% aqueous solution of methylcellulose | 5 parts |
| water | 40 parts |

② Preparation of dispersion $B_3$

The following composition was pulverized by a sand mill, and the pulverization was continued until an average particle size of 3 μm.

| | |
|---|---|
| 4,4'-isopropylidenediphenol | 30 parts |
| 5% aqueous solution of methylcellulose | 5 parts |
| water | 80 parts |

③ Preparation of dispersion $C_3$

The following composition was pulverized by a sand mill, and the pulverization was continued until an average particle size of 3 μm.

| | |
|---|---|
| 1,2-di(3-methylphenoxy)ethane | 20 parts |
| 5% aqueous solution of methylcellulose | 5 parts |
| water | 55 parts |

④ Preparation of dispersion $D_3$

The following composition was pulverized by a sand mill, and the pulverization was continued until an average particle size of 3 μm.

| | |
|---|---|
| 4,4'-diglycidyloxydiphenylsulfone | 20 parts |
| 5% aqueous solution of methylcellulose | 5 parts |
| water | 55 parts |

⑤ Formation of a recording layer 55 parts of dispersion $A_3$, 115 parts of dispersion $B_3$, 80 parts of dispersion $C_3$, 24 parts of dispersion $D_3$, 80 parts of 10% polyvinylalcohol aqueous solution, 35 parts of calcium carbonate were mixed and pulverized, and then thus obtained coating composition was coated in an amount of 6 g/m$^2$ on dry basis on the base sheet of 50 g/m$^2$ and dried to obtain a heat-sensitive record material having a recording layer on the base sheet.

EXAMPLE 19

A heat-sensitive record material was obtained in the same manner as in Example 18 except that 4-hydroxy-4'-isopropoxydiphenylsulfone was used instead of 4,4'-isopropylidenediphenol to prepare the dispersion $B_3$.

EXAMPLE 20

A heat-sensitive record material was obtained in the same manner as in Example 18 except that 4-glycidyloxy-4'-methyldiphenylsulfone was used instead of 4,4'-diglycidyloxydiphenylsulfone to prepare the dispersion $D_3$.

EXAMPLE 21

A heat-sensitive record material was obtained in the same manner as in Example 18 except that 4-glycidyloxy-4'-isopropoxydiphenylsulfone was used instead of 4,4'-diglycidyloxydiphenylsulfone to prepare the dispersion $D_3$.

EXAMPLE 22

A heat-sensitive record material was obtained in the same manner as in Example 18 except that 4,4'-diglycidyloxy-3,3',5,5'-tetrabromo-diphenylsulfone was used instead of 4,4'-diglycidyloxydiphenylsulfone to prepare the dispersion $D_3$.

EXAMPLE 23

A heat-sensitive record material was obtained in the same manner as in Example 18 except that 24 parts of the following dispersion $E_3$ was added to the coating composition for the recording layer.

⑥ Preparation of dispersion $E_3$

The following composition was pulverized by a sand mill, and the pulverization was continued until an average particle size of 3 μm.

| | |
|---|---|
| 1-[α-methyl-α-(4'-hydroxyphenyl)ethyl]-4-[α',α'-bis(4''-hydroxyphenyl)ethyl] benzene | 20 parts |
| 5% aqueous solution of methylcellulose | 5 parts |
| water | 55 parts |

COMPARATIVE EXAMPLE 6

A heat-sensitive record material was obtained in the same manner as in Example 18 except that the dispersion $D_3$ was not used in the formation of the recording layer.

COMPARATIVE EXAMPLE 7

A heat-sensitive record material was obtained in the same manner as in Example 19 except that the dispersion $D_3$ was not used in the formation of the recording layer.

COMPARATIVE EXAMPLE 8

A heat-sensitive record material was obtained in the same manner as in Example 18 except that 3-(N-ethyl-N-isoamyl)amino-6-methyl-7-phenylaminofluoran was used instead of 3-dibutylamino-6-methyl-7-phenylaminofluoran to prepare the dispersion $A_3$.

COMPARATIVE EXAMPLE 9

A heat-sensitive record material was obtained in the same manner as in Example 18 except that 3-diethylamino-6-methyl-7-phenylaminofluoran was used instead of 3-dibutylamino-6-methyl-7-phenylaminofluoran to prepare the dispersion $A_3$.

COMPARATIVE EXAMPLE 10

A heat-sensitive record material was obtained in the same manner as in Example 18 except that 3-dibutylamino-7-(o-chlorophenylamino)fluoran was used instead of 3-dibutylamino-6-methyl-7-phenylaminofluoran to prepare the dispersion $A_3$.

The properties of thus obtained 11 heat-sensitive record materials were evaluated by the following methods. The results are shown in Table 4.

Whiteness

The same method as used in Table 1.

Image density of the developed color

The same method as used in Table 1.

Plasticizer-resistance

The same method as used in Table 1.

Oil-resistance

After developing color images, a few drops of cotton seed oil was dropped on the color images of the heat-sensitive record material, allowed to stand for 8 hours and then wiped with a guaze. The optical density of the color images was measured by Macbeth densitometer.

TABLE 4

| | Whiteness (%) | Image density of the color images after recording | Plasticizer-resistance | Oil-resistance |
|---|---|---|---|---|
| Example | | | | |
| 18 | 82.0 | 1.24 | 1.14 | 1.13 |
| 19 | 83.3 | 1.20 | 1.16 | 1.18 |
| 20 | 82.5 | 1.22 | 1.12 | 1.10 |
| 21 | 82.2 | 1.23 | 1.13 | 1.14 |
| 22 | 82.4 | 1.23 | 1.13 | 1.12 |
| 23 | 82.0 | 1.23 | 1.16 | 1.15 |
| Comparative Example | | | | |
| 6 | 82.2 | 1.22 | 0.20 | 0.30 |
| 7 | 83.4 | 1.20 | 0.35 | 0.42 |
| 8 | 52.2 | 1.24 | 1.10 | 1.12 |
| 9 | 48.3 | 1.23 | 1.12 | 1.13 |
| 10 | 82.0 | 1.10 | 0.30 | 0.43 |

EXAMPLE 24

① Formation of a recording layer

A recording layer was formed on the base sheet in the same manner as in Example 18.

② Formation of a protective layer

The following composition was mixed with stirring to prepare a coating composition.

| | |
|---|---|
| 10% aqueous solution of acetoacetylated polyvinyl alcohol | 100 parts |
| calcium carbonate | 20 parts |
| water | 50 parts |

The coating composition was coated on the above recording layer in an amount of 6 g/m$^2$ on dry basis, and dried to obtain a heat-sensitive record material having a protective layer.

EXAMPLE 25

① Formation of a recording layer

A recording layer was formed on the base sheet in the same manner as in Example 19.

② Formation of a protective layer

A protective layer was formed on the above recording layer in the same manner as in Example 24 to obtain a heat-sensitive record material having the protective layer.

EXAMPLE 26

① Formation of a recording layer

A recording layer was formed on the base sheet in the same manner as in Example 23.

② Formation of a protective layer

A protective layer was formed on the above recording layer in the same manner as in Example 24 to obtain a heat-sensitive record material having the protective layer.

COMPARATIVE EXAMPLE 11

① Formation of a recording layer

A recording layer was formed on the base sheet in the same manner as in Comparative example 6.

② Formation of a protective layer

A protective layer was formed on the above recording layer in the same manner as in Example 24 to obtain a heat-sensitive record material having the protective layer.

COMPARATIVE EXAMPLE 12

① Formation of a recording layer

A recording layer was formed on the base sheet in the same manner as in Comparative example 7.

② Formation of a protective layer

A protective layer was formed on the above recording layer in the same manner as in Example 24 to obtain a heat-sensitive record material having the protective layer.

COMPARATIVE EXAMPLE 13

① Formation of a recording layer

A recording layer was formed on the base sheet in the same manner as in Comparative example 8.

② Formation of a protective layer

A protective layer was formed on the above recording layer in the same manner as in Example 24 to obtain a heat-sensitive record material having the protective layer.

COMPARATIVE EXAMPLE 14

① Formation of a recording layer

A recording layer was formed on the base sheet in the same manner as in Comparative example 10.

② Formation of a protective layer

A protective layer was formed on the above recording layer in the same manner as in Example 24 to obtain a heat-sensitive record material having the protective layer.

The properties of thus obtained 7 heat-sensitive record materials were evaluated by the following methods. The results are shown in the Table 5.

Whiteness

The same method as used in Table 1.

Image density of the developed color

The same method as used in Table 1.

Plasticizer-resistance

The same method as used in Table 1 was carried out except that the resultant material was allowed to stand at 40° C. for 24 hours instead of 30° C. for 24 hours.

Wet-plasticizer-resistance

The heat-sensitive record material was slightly wetted by water and then tested in the same manner as in the above plasticizer-resistance test.

Oil-resistance

The same method as used in Table 4 was carried out except that the drops of cotton seed oil were allowed to stand for 24 hours instead of 8 hours.

TABLE 5

| | | Image density of the color images | | | |
|---|---|---|---|---|---|
| | Whiteness (%) | after recording | Plasticizer-resistance | Wet-plasticizer resistance | Oil-resistance |
| Example | | | | | |
| 24 | 80.5 | 1.12 | 1.06 | 1.01 | 1.06 |
| 25 | 81.2 | 1.10 | 1.07 | 1.03 | 1.09 |
| 26 | 80.3 | 1.14 | 1.12 | 1.11 | 1.09 |
| Comparative Example | | | | | |
| 11 | 80.3 | 1.10 | 0.20 | 0.15 | 0.33 |
| 12 | 80.9 | 1.08 | 0.35 | 0.15 | 0.42 |
| 13 | 40.2 | 1.10 | 1.06 | 1.00 | 1.06 |
| 14 | 80.4 | 0.95 | 0.23 | 0.25 | 0.45 |

As shown in Tables 1 to 5, each of the heat-sensitive record material according to the present invention is superior in good retainability of the recorded images, and stably maintains the unrecorded white portions fogging-free.

What we claim is:

1. A heat-sensitive record material having on a base sheet a heat-sensitive recording layer comprising a colorless or pale colored basic chromogenic material and a color developer which develops a color by contacting with said chromogenic material, characterized in that said recording layer comprises at least one epoxy resin represented by the following formula:

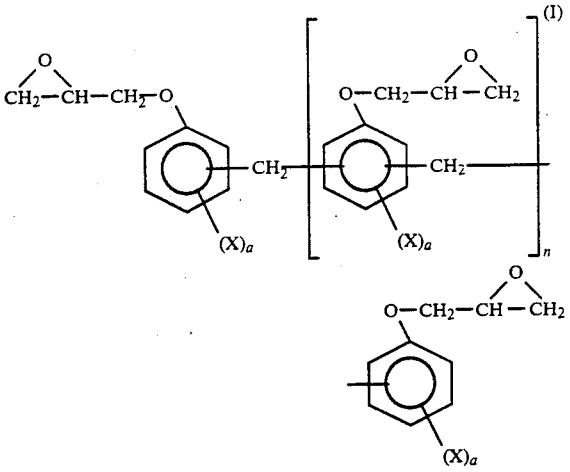

(I)

wherein X is a halogen atom or an alkyl having $C_1$ to $C_5$; a is an integer of 0 to 4; and n is an integer of 0 to 20.

2. A heat-sensitive record material as defined in claim 1, wherein the epoxy resin has a softening point of 60° to 140° C.

3. A heat-sensitive record material as defined in claim 1, wherein n is an integer of 2 to 7 in the epoxy resin represented by the general formula (I).

4. A heat-sensitive record material as defined in claim 1, wherein a compound represented by the following formula (II) is contained in the recording layer;

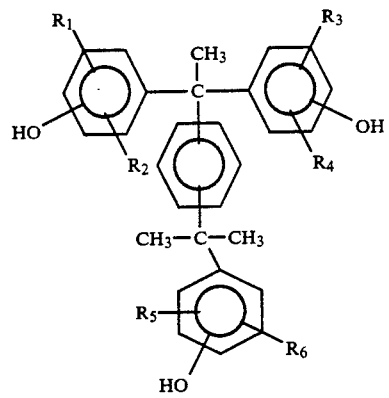

(II)

wherein $R_1$, $R_2$, $R_3$, $R_4$, $R_5$ and $R_6$ may be the same or different from each other, and each of them is a hydrogen atom, halogen atom, alkyl having $C_1$ to $C_5$ or alkoxyl having $C_1$ to $C_5$.

5. A heat-sensitive record material as defined in claim 4, wherein the compound represented by the general formula (II) is 1-[α-methyl-α-(4'-hydroxyphenyl)ethyl]-4-[α',α'-bis(4''-hydroxyphenyl)ethyl]benzene.

6. A heat-sensitive record material as defined in claim 1, wherein the heat-sensitive record material has a protective layer as the most outer layer of the recording surface.

* * * * *